US011154101B2

(12) United States Patent
Karakostas

(10) Patent No.: US 11,154,101 B2
(45) Date of Patent: Oct. 26, 2021

(54) PROTECTIVE MASK WITH NO-TOUCH ACCESS FLAP

(71) Applicant: Andrew Karakostas, Syosset, NY (US)

(72) Inventor: Andrew Karakostas, Syosset, NY (US)

( * ) Notice: Subject to any disclaimer, the term of this patent is extended or adjusted under 35 U.S.C. 154(b) by 0 days.

(21) Appl. No.: 16/930,560

(22) Filed: Jul. 16, 2020

(65) Prior Publication Data

US 2020/0404991 A1 Dec. 31, 2020

(51) Int. Cl.
*A41D 13/11* (2006.01)
*A41D 31/18* (2019.01)

(52) U.S. Cl.
CPC ..... *A41D 13/1161* (2013.01); *A41D 13/11* (2013.01); *A41D 13/113* (2013.01); *A41D 31/18* (2019.02)

(58) Field of Classification Search
CPC .. A41D 13/11; A41D 13/1138; A41D 13/113; A41D 13/1107; A41D 13/1146; A41D 13/1161; A41D 31/18; A62B 23/00; A62B 23/02; A62B 23/025; A62B 23/0235; A62B 7/10; A41G 7/02
USPC ..... 2/206, 9; 128/206.15, 206.13, 206.21
See application file for complete search history.

(56) References Cited

U.S. PATENT DOCUMENTS 2,507,447 A * 5/1950 La Joie ..... A45D 44/12 2/174
3,768,100 A * 10/1973 Colman ..... A41D 13/1161 2/9
6,945,249 B2 * 9/2005 Griesbach, III ... A41D 13/1146 128/206.12
7,044,127 B1 * 5/2006 Fernandez DeCastro ..... A41D 13/11 128/202.15
2004/0074498 A1 * 4/2004 Begum ..... A41D 13/1192 128/206.21
2006/0102183 A1 * 5/2006 Skov ..... A41D 13/1146 128/206.19
2006/0130841 A1 * 6/2006 Spence ..... A41D 13/1107 128/206.19
2011/0180078 A1 * 7/2011 McKinley ..... A41D 13/1161 128/863
2012/0060843 A1 * 3/2012 Magidson ..... A41D 13/1115 128/206.19
2017/0209719 A1 * 7/2017 Tang ..... A41D 13/11
2020/0329792 A1 * 10/2020 Howard ..... A41D 13/1107

* cited by examiner

*Primary Examiner* — Khoa D Huynh
*Assistant Examiner* — Aiying Zhao
(74) *Attorney, Agent, or Firm* — Alan M. Sack; SACK IP Law p.c.; John F. Vodopia

(57) ABSTRACT

A protective face mask for maintaining a protective covering over a wearer's nose and mouth that allows for safe intake of food and/or drink includes a mask body, and upper and lower straps connected to the mask body that allow the protective face mask to be secured to the wearer's head. The mask body includes a flap portion that is connected to the mask body by left and right bellows portions. A tether is connected to the flap portion that may be grasped and force applied to draw the flap portion away from the face of the wearer, expanding the left and right bellows portions and creating an opening under a bottom edge of the flap portion at the bottom of the mask body to allow access to the wearer's mouth until the force applied is removed.

24 Claims, 6 Drawing Sheets

PROTECTIVE MASK WITH NO-TOUCH ACCESS FLAP

BACKGROUND OF THE INVENTION

1. Field of the Invention

This invention relates to protective face masks. More particularly, the invention relates to protective face masks formed with a flap portion provided in a lower part of the body of the mask that is connected to a pull cord that is grasped by the wearer to lift the flap portion away from the wearer's face, creating a temporary opening through which food and/or drink may be passed to the wearer's mouth, whereupon releasing the cord allows the flap portion to move back to its non-deployed position that covers the temporary opening, without the wearer contacting the body of mask directly, minimizing contamination risk.

2. Background of the Related Art

Conventional protective face masks function as filtration respirators that are widely used to protect the respiratory system from particulate or chemical agents. Conventional protective face masks are designed to minimize the transmission of contagious diseases or to protect the respiratory system from toxic substances or allergens in the surrounding atmosphere. Protective face masks maintain a substantially enclosed space around the nose and mouth (i.e., the breathing orifices) for receiving air filtered by the mask body. Infectious persons can wear masks to protect other people in the vicinity from their pathogens. Masks can be used to protect non-infected persons, who can wear masks to prevent being infected by breathing in airborne pathogens, including bacteria and viruses.

Various protective face masks are known. For example, U.S. Pat. No. 2,494,406 discloses a protective mask which has elastic temple straps attached to the mask to enhance the conforming to the face of the wearer.

U.S. Pat. No. 6,098,201 discloses a molded face mask made of a plastic sheet in which a deformable wire is embedded so that the mask better conforms to the wearer's face.

U.S. Pat. No. 4,827,923 shows a protective facial mask that slips over the user's head.

U.S. Pat. No. 6,123,077 discloses a mask with a flat central panel to which other panels are joined through a fold line, seam, weld, or bond.

U.S. Pat. No. 4,974,586 provides breathing mask with an inhalation valve disposed in an opening of the wall of the mask, which opens at a sufficiently low breathing pressure to make it comfortable.

U.S. Pat. No. 5,699,792 presents a face mask with an enhanced facial seal.

U.S. Pat. No. 5,701,892 presents a two-sided chamber held away from the entrance of the nostrils and the mouth by a rigid support.

U.S. Pat. No. 4,941,470 depicts a face mask having pleats formed therein and a method for fabricating the mask.

U.S. Pat. No. 6,394,090 presents a respiratory device having first and second lines of demarcation bisected by a fold so that the device can be folded.

U.S. Pat. No. 4,856,509 discloses a face mask containing a chemical or biological agent that destroys microorganisms such as viruses and bacteria.

U.S. Pat. No. 5,819,731 teaches a face mask having a combination of adjustable ear loops and drop down band for a snug fit.

U.S. Pat. No. 5,717,991 discloses a disposable sanitary mask comprising a cover panel section adapted to cover the wearer's nose and mouth and a pair of ear loops and panel sections to prevent the mask from losing its shape.

U.S. Pat. No. 5,735,270 discloses a disposable foldable face mask with face seal characteristics for a high efficiency filtering medium.

U.S. Pat. No. 6,213,125, discloses a device for protecting the face of the wearer including a gas pervious mask dimensioned to fit over the nose and mouth and a shield to protect the eyes of the wearer.

U.S. Pat. No. 6,332,465 discloses face masks having elastic polyolefin thermoplastic bands attached thereto by heat and pressure.

U.S. Pat. No. 6,055,982 discloses a face mask which prevents transmission of air borne aerosols, particulate matter, and/or liquids, having an enhanced fluid barrier between the periphery of the mask and the wearer's face.

U.S. Pat. No. 7,044,127 ("the '127 patent") discloses a multipurpose mask that "maintain[s] some protection from the environment even when the wearer requires hydration or nutrients" (col 2, Line 40-43); "a mask that can be worn by the user for extended periods of time that are not limited to times not needed for sustenance of the wearer" (col 2, lines 47-49), does so while providing the wearer protection all time (col 2, lines 51-52) and has "at least one opening or area that can be opened so that the wearer can take nourishment . . . without removing the mask (col 2, lines 55-56). The area designed for introduction of nourishment is readily re-closed after nourishment is taken . . . thus providing the greatest degree of protection for the wearer." (col 2, lines 61-64). "The area designed for introduction of nourishment is readily re-closed after nourishment is taken . . . the area can be a closed area that permits a delivering device, such as a straw, spoon or tube, to be inserted, and which self closes or self-reseals once the wearer no longer needs the device." (col 2, line 61-col 3, line 2). FIG. 1 of the '127 patent is reproduced as prior art FIG. 1. Prior art FIG. 1 shows one embodiment of the mask, which is made of "any type" of material that can be comfortably worn, either flexible or inflexible, proximate the wearer's mouth.

A piece of flexible, elastic material 10 is attached to the mask at 10*a*, except for an area which approximately covers the lower lip of the wearer indicated by 10*b*, which is free. FIG. 2 of the '127 patent is reproduced as prior art FIG. 2. This elastic or flexible material forms a separate cover for the upper or high lip of the wearer 11. The high lip 11 is attached to the mask indicated by 11*a* except for the lower edge of the high lip 11*b*. The free edge 11*b* of the high lip extends over the free edge of the low lip 10*b*. The embodiment is intended for limited insertion into the mask space, such as device 20, as shown in prior art FIG. 2 inserted between the upper and lower lips through the opening. FIGS. 3, 3a and 5 of the '127 patent are reproduced as prior art FIGS. 3, 4 and 5.

FIG. 3 of the '127 patent, as shown in prior art FIG. 3, depicts the mask with an aperture 13 proximate the location of the wearer's mouth, and covered by a flap 14 attached to the mask above the aperture indicated by 15. The lower part of the flap 15*a* is lightly attached to the mask so that the flap 14 can be raised when the wearer chooses to ingest food or beverages. FIG. 3a of the '127 patent, depicted as prior art FIG. 4, is a side view of the mask of FIG. 3 of the '127 patent, showing the solid flap 14 and the aperture 13 behind the flap 14 so that the wearer can insert a device through such aperture when the bottom of the flap 15*a* is raised.

FIG. 5 of the '127 patent, depicted as prior art FIG. 5, shows a mask having a single orifice or aperture 17 through which the wearer can insert food or drink into the wearer's mouth. A detachable cover 18 covers the orifice when the wearer is not eating or drinking. This cover 18 can be attached to the mask by any conventional attaching or adhesive means, such as hook and loop closures, reusable adhesive, snaps, hooks and eyes, etc. FIG. 5a of the '127 patent (not shown) shows the detachable cover 18 with an adhesive 19 around the periphery of the cover.

The mask of the '127 patent, however, always has the opening proximate the wearer's mouth, central to the face mask. As the opening is very close to the user's nose and mouth, contacting the mask to pass through tubes and the like is an unsafe practice. For that matter, pushing the tube through the opening very likely would contaminate the tube with pathogens filtered out of the incoming air but nevertheless populating the mask breathing/filtering surfaces.

Also known is U.S. Pat. No. 7,958,889 ("the '889 patent"). The '889 patent discloses a protective face mask for filtering dust, particulates, odors and pathogens that might otherwise be breathed in by the wearer. The protective face mask has moldable attachment that is constructed so that it can be opened and closed at will to allow for insertion of devices such as straws, tubes, top-sports bottles, etc. for introducing liquids, solids, semisolids, chemicals or medicines. As such, the wearer need not remove the mask during eating or drinking taking a pill or the like. While masks are known that have guarded openings, such as shown in the '127 patent, the moldable attachment described in the '889 patent is more versatile and can accommodate a greater variety of inserted devices. The moldable attachment can fit over a mask opening to provide protection for the wearer and better accommodate a variety of devices to provide hydration or nourishment (including straws of different sizes, spoons, forks, sports bottle mouths, etc.) The moldable attachment is opened and closed by different types of motion, such as rotation, sliding, flipping, and the like, nonlimiting examples of which are shown in FIGS. 8 through 11.

Like the mask of the '127 patent, the mask provided by the '889 patent always has the opening 130 proximate the wearer's mouth ("A moldable attachment 104 is provided near the mouth of wearer of the mask."). The opening is central to the face mask. Because of the opening's proximity to the user's nose and mouth, contacting the moldable attachment to pass material therethrough is an unsafe practice. Any pathogens that might be inadvertently introduced to the moldable attachment have a high risk of passing into the wearer's nose or mouth. breathing/filtering surfaces.

Chinese Pat. Publ. No. 105559198 ("the '198 China Appln.") discloses a protective facial mask having an opening located below the nose . . . in the mouth part of the facial mask with a mouth baffle piece/[flap], which is capable of completely covering the opening (Abstract), the block piece/[flap] fixed in mask body . . . enabling the promotion of the both sides of the block/[flap] piece when exhaling [to form] two gaps . . . for air-flow. (Summary of the invention, paragraph 2). FIGS. 1 and 2 of the '198 publication are reproduced as prior art FIGS. 6 and 7 herein.

The facial mask includes an opening (4 in FIG. 2 of the '198 China Appln.) covered by a flap (5 in FIGS. 1 and 2 of the '198 China Appln.) that has both the upper and lower edges of the flap fixed to the mask body by viscose glue. The two sides of the flap, during exhalation of the wearer, become two gaps formed between the mask body for airflow discharge. (Abstract and Summary of Invention, paragraph 2 of the '198 China Appln.). The openings formed in the mask close upon the wearer inhaling and the airflow presses the mouthpiece back to the face, as described in the Summary of Invention, paragraph 2 and claim 1 of the '198 China Appln.

FIG. 2 of the '198 China Appln., corresponding to prior art FIG. 7, illustrates one edge of the flap (5) being attached/sealed to the mask body (the top edge), leaving both sides unsealed for the wearer's exhaled breath to be released. The flap "5" is drawn as lifted to reveal to existence of opening "4." What is seen in the opening 4 is merely the continuation of the bottom portion of the "tether" (the continuous string 2) that ties behind the wearer's neck. The openings discharge/drain/expel the exhaled exhaust gas of the wearer in a more timely manner (Summary of the invention, paragraph 1 of the '198 China Appln.). The hole or aperture for doing so is a part of the mask and is covered by a flap that provides two sides that form openings upon the wearer exhaling. These are closed upon the force created when the wearer inhales.

Like the protective masks disclosed by the '127 patent, and the '889 patent, the mask of the '198 China application always has the opening 4 proximate the wearer's mouth, which is central to the face mask. And as the opening is very close to the user's nose and mouth. Accordingly, pathogens may enter proximate the nose/mouth when opened for exhale. And any contact with the outer surface, such as the flap, increases a possibility that pathogens stopped by the mask outer surface might be transferred to the wearer's hand, on contact.

The aforementioned facemasks do not allow for safe access to the small volume formed around the user's breathing orifices by the respective masks. In all of these masks, when the wearer wishes to eat, drink, speak clearly, smoke, etc. (which activities are prevented or limited by the deployed face mask), the face mask must be removed or a portion of it moved away from breathing orifices. And of course, this subjects the wearer to the very allergens, infectious agents, chemicals, etc., for which the mask is worn to protect. For that matter, as the bodies of the protective face masks operate to filter air breathed therethrough, the outer surface of the mask may collect the pathogens blocked from passing through the mask body. With pathogens collected on the outer surfaces, touching the mask may transfer pathogens risking infection.

SUMMARY OF THE INVENTION

The present invention overcomes the shortcomings of the known arts, such as those mentioned above. The invention includes a protective face mask that gives the wearer protection against breathing airborne particles, including potentially dangerous pathogens, such as bacterium, viruses, molds, spores allergens, and alike, while also allowing the wearing the ability to enjoy food and drink without touching the mask directly, or removing the mask. As such, the inventive protective face mask is ideal for protecting wearers out in public where food and drink may be consumed, again, without removing the protective face mask and therefore, without endangering a wearer to infection by removing the mask when the wearer eats/drinks.

The inventive protective mask is ideal for wearers concerned about a risk of infection by airborne pathogens, while visiting beaches, picnic areas, sporting events, concerts, any type of large gatherings, such as rallys, and industrial uses such as painting and construction, where eating and drinking are a necessary activity.

The inventive protective face mask includes features of a conventional N95 mask, and may be disposable in one embodiment. Alternatively, the invective protective mask may be made of washable fabric with a replacement filter.

In an embodiment, the protective face mask comprises a continuous sheet of flexible material that does not have any holes, apertures, openings or gaps that pierce the continuous layer of material covering both the nose and mouth. The protective mask enables access to the wearer's mouth at will, i.e., the wearer may manually move a portion of a lowest edge of the mask to create an opening that allows access to the wearer's mouth. The opening is appropriate for the wearer of the mask to both eat and drink. The wearer grasps a tether attached to the mask, such as a cord or loop, preferably without touching the mask or wearer's face, and draws on the loop away from the mask thereby creating an opening below the mask.

The purpose of the cord is to create separation between the hand and face so there is no need to touch the mask while using it. When the cord is pulled away from the face, the opening is only underneath and the sides are made from a similar but thinner material that fold in an accordion style manner and has just enough elastic in it to be able to return back to its closed position. When fully extended, the mask will allow up to a 4"×4" opening."

In an embodiment, the invention provides a protective face mask for maintaining a protective covering over a wearer's nose and mouth that allows for safe intake of food and/or drink. The protective face mask comprises a mask body, and upper and lower straps connected to a remainder of the mask body that allow the protective face mask to be secured to the wearer's head. The mask body includes a flap portion connected to the mask body by left and right bellows portions, the flap extending to the bottom of the mask. A tether is connected to the flap portion that may be grasped and force applied to draw the flap portion away from the face of the wearer, expanding the left and right bellows portions and creating an opening under a bottom edge of the flap portion until the force applied is removed.

The flap portion may be quasi-triangular. Preferably, the flap portion includes a left edge, a right edge and a bottom edge, and the bellows sections, which connect the left and right edges of the flap section to a remainder of the mask body, are pleated. The mask body 22 may comprise a continuous sheet of flexible, filter material that does not have any holes, apertures, openings or gaps that pierce the continuous layer of material covering both the nose and mouth. The mask body may further comprise one or more one-way valves arranged to allow for easier breathing, and optionally, an attached filter material arranged between the flap portion and the mouth/and/or nose of the wearer. The upper and lower straps are preferably continuous to form a loop around the user's ears.

The protective mask preferably comprises a button or snap one side of the mask body proximate the flap portion, such that one end of the lower strap is fixed to the mask body opposite the one side of the mask body proximate the stretchable lower portion, and another end of the lower strap is detachably connected to the button or snap. Preferably, the straps are made of stretchable material so that the straps may be stretched by application of a stretching force, and such that upon removal of the stretching force, the straps return to their non-stretched form.

In another embodiment, the invention provides a protective face mask for maintaining a protective covering over a wearer's nose and mouth that allows for safe intake of food and/or drink. The protective face mask comprises a mask body, and upper and lower straps connected to the mask body that allow the protective face mask to be secured to the wearer's head. The mask body includes a stretchable lower portion that is connected to the mask body that is to be positioned below the nose of the wearer. A tether is connected to the stretchable lower portion that may be grasped and force applied to draw the stretchable lower portion away from the face of the wearer and creating an opening under a bottom edge 32B of the stretchable lower portion until the force applied is removed.

The mask body and stretchable lower portion together comprise a substantially continuous sheet of flexible and stretchable fabric, which does not have any holes, apertures, openings or gaps that pierce the continuous sheet of flexible and stretchable fabric covering both the nose and mouth. Preferably, the mask further comprises attached filter material arranged between the stretchable lower portion and the wearer's mouth and/or nose. In one form, the mask body material forming an area of the mask body proximate the mouth of the wearer may be more rigid than mask body material that material forming the remainder of the mask body that surrounds the mask body material forming the more rigid mask area, whereby the mask allows for chewing and making eating more comfortable when the mask is closed over the user's face. Also, the mask body may further include one or more one-way valves arranged to allow for easier breathing, and preferably, the respective upper and lower straps are continuous to form a loop around the user's ears.

The inventive mask may further include a lower strap 38 provided to surround the wearer's jaw to hold the mask firmly, and further comprises a button or snap one side of the mask body proximate the stretchable lower portion, where one end of the lower strap is fixed to the mask body opposite the one side of the mask body proximate the stretchable lower portion, and another end of the lower strap is detachably connected to the button or snap. Preferably, the straps are made of stretchable material so that the straps may be stretched by application of a stretching force, and such that upon removal of the stretching force, the straps return to their non-stretched form.

BRIEF DESCRIPTION OF THE DRAWINGS

Further features and advantages of the invention will become apparent from the description of embodiments that follows, with reference to the attached figures, wherein.

DETAILED DESCRIPTION OF THE INVENTION

Figure 1:
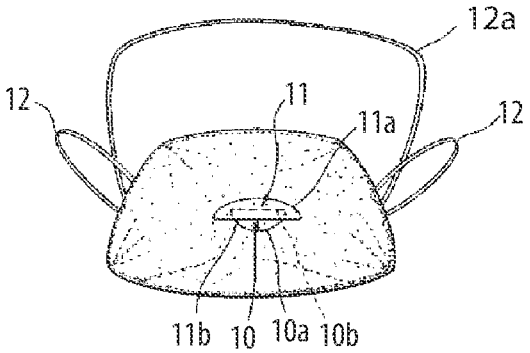
Fig. 1 (Prior Art)
FIG. 1 depicts a prior art mask with an opening for a delivery device.
Figure 2:
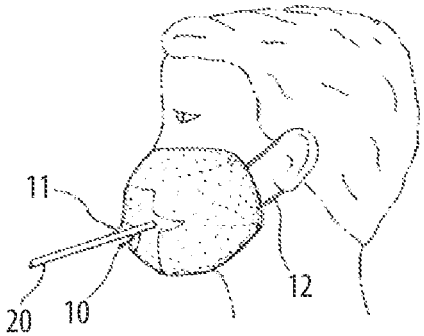
Fig. 2 (Prior Art)
FIG. 2 depicts a side view of the prior art mask of FIG. 1, highlighting a delivery device inserted in opening.
Figure 3:
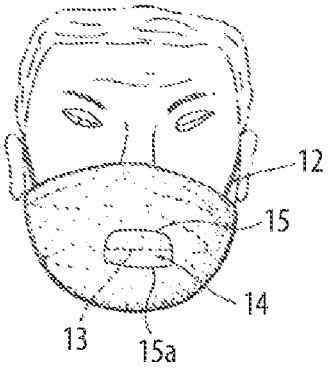
Fig. 3 (Prior Art)
FIG. 3 depicts a prior art mask with a flap.
Figure 4:
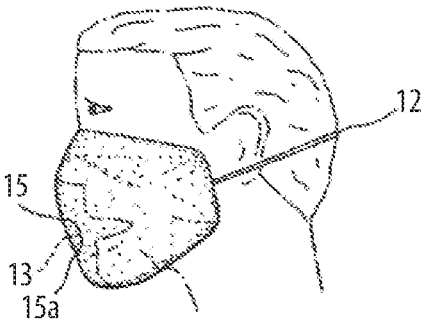
Fig. 4 (Prior Art)
FIG. 4 depicts a side view of the prior art mask of FIG. 3.
Figure 5:
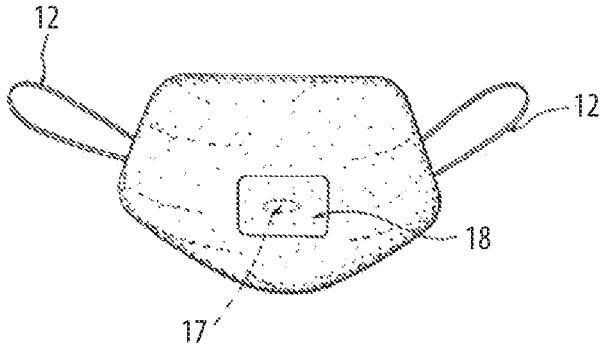
Fig. 5 (Prior Art)
FIG. 5 depicts a prior art mask with a single orifice with an attached cover.
Figure 6:
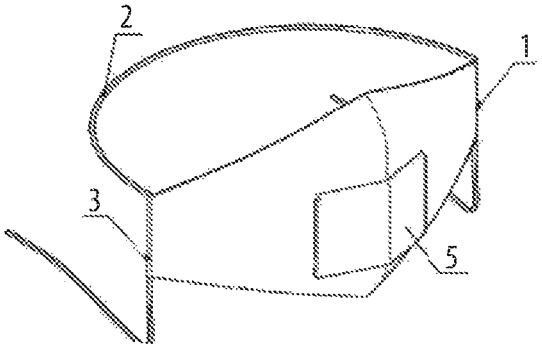
Fig. 6 (Prior Art)
FIG. 6 depicts a prior art mask with an opening in a closed state.
Figure 7:
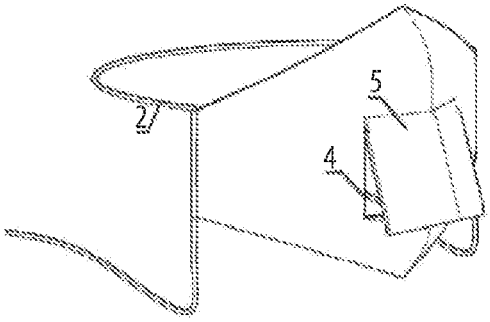
Fig. 7 (Prior Art)
FIG. 7 depicts the prior art mask of FIG. 6, where the opening is in an open state.

The following is a detailed description of example embodiments of the invention depicted in the accompanying drawings. The example embodiments are presented in such detail as to clearly communicate the invention and are designed to make such embodiments obvious to a person of ordinary skill in the art.

The invention includes a protective face mask that gives the wearer protection against breathing airborne particles, such as viruses, while also allowing the wearer the ability to enjoy food and drink without touching the mask directly or removing the mask. The inventive protective mask is ideal for wearers concerned about a risk of infection by airborne pathogens, while visiting beaches, picnic areas, sporting events, concerts, any type of large gatherings, such as rally's, and industrial uses such as painting and construction, where eating and drinking are a necessary activity. The mask may be disposable or alternatively, the inventive protective mask may be made of washable fabric with a replacement filter.

The inventive protective face mask 20 is depicted in FIGS. 8-11 in its most basic form, arranged over the nose and mouth of a wearer 10, as shown. The protective face mask 20 comprises a mask body 22, an upper strap 24, a lower strap 26 and a metal nose shaper 28. The upper straps 24 may join together above the user's ears and around the user's head; and the lower straps 26 may also join together around a lower portion of the user's head, below the ears. Alternatively, straps 24, 26 may each join and loop around one of the user's ears. In one embodiment, as shown, a flap portion 30 is connected to a remainder of the mask body 22. Flap portion 30 is quasi-triangular shaped and includes a left edge 32L, a right edge 32R and a bottom edge 32B extending along the bottom of the mask body 22. A left bellows section 34L and a right bellows section 34R, which bellows sections are pleated (See FIG. 11), connect the left edge 32L and right edge 32R to the mask body 22. Preferably, the pleats (as shown) are maintained in a non-deployed state in reliance upon an elastic part 33B that extends through all of the pleat portions of bellows sections 32L and 32R (see FIG. 11). A tether, comprising a cord or string 36, is grasped by the wearer to lift the flap portion 30 away from the lower portion of the wearer's face, to enable access to the wearer's mouth from below. The tether may comprise elastic material.

Figure 13A:
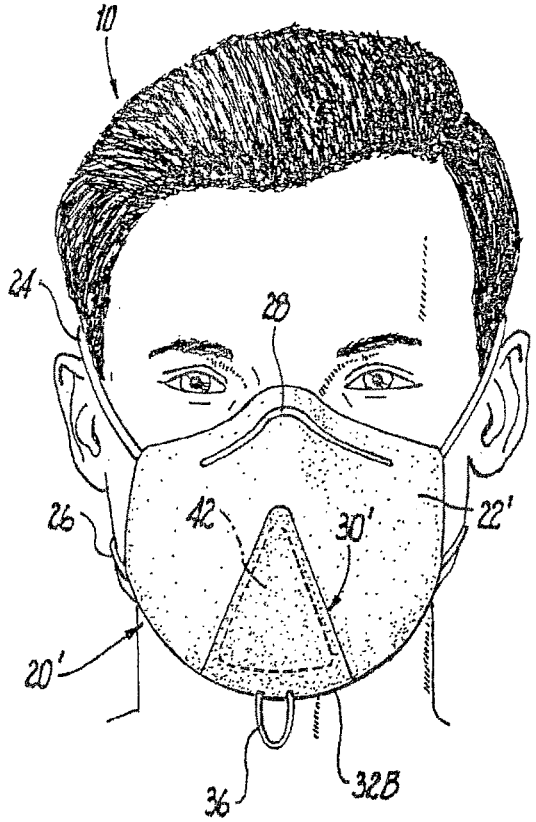
FIG. 13 depicts an alternative embodiment of the protective face mask of FIGS. 8-12, where the cord or string is grasped and draws a stretchy portion of the mask away to realize an opening.
FIG. 13B depicts an alternative embodiment of the protective face mask of FIG. 13A, where the mask body material forming an area of the mask body proximate the mouth of the wearer is more rigid than mask body material forming the remainder of the mask body that surrounds the mask body material forming the more rigid mask area.
Figure 14:
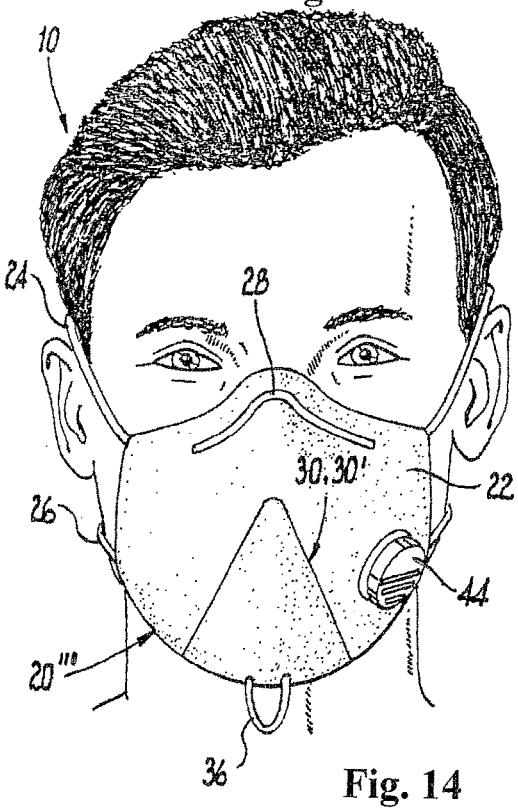
FIG. 14 depicts an alternative embodiment of the protective face masks depicted in FIGS. 8-13, which includes at least one one-way valve 44 positioned to make breathing easier

Alternatively, if the mask is made of a flexible, stretchable fabric material, the bellows portions 34*r*, 34L may be replaced by a flexible-stretchable fabric that may be pulled away from the user's mouth with a cord or string, as described above, to permit access to the user's mouth from below the mask (FIGS. 13 and 14). The stretchable lower portion of the mask may include an attached filter material 42. Preferably, the area around the wearer's mouth is more rigid than the surrounding material to allow for chewing and making eating more comfortable when the mask is closed.

The mask body 22 comprises a continuous sheet of flexible, filter material that does not have any holes, apertures, openings or gaps that pierce the continuous layer of material covering both the nose and mouth. The mask body 22 and flap portion 30 may optionally comprise flexible, semi-rigid or rigid material. The mask body 22 may be spaced from or may mold or may be molded to the shape of the user's face, depending on the type of material used for the mask body. The flap portion 30, is separated from a remainder of the mask body by the left 34L and right 34R bellows sections, which with the flap portion and mask body 22 for a continuous sheet of protection. But to access the wearer's mouth, the tether (string or cord) 36 is grasped (without touching an outer surface of the mask body 22 or the flap portion 30), pulling the bottom edge 32B of the flap portion 30 away from the wearer's face. As such, there is no opening or aperture in the mask proximate the wearer's mouth and/or nose. If the user lifts the flap portion 30, using tether (cord) 36, the opening stays open and the user's mouth is accessible from below, only as long as the wearer holds the flap portion open. Once the wearer stops pulling on the tether 36, the elastic straps 33B collapse the flap portion back against the user's face, preventing any pathogens from entering.

Figure 11:
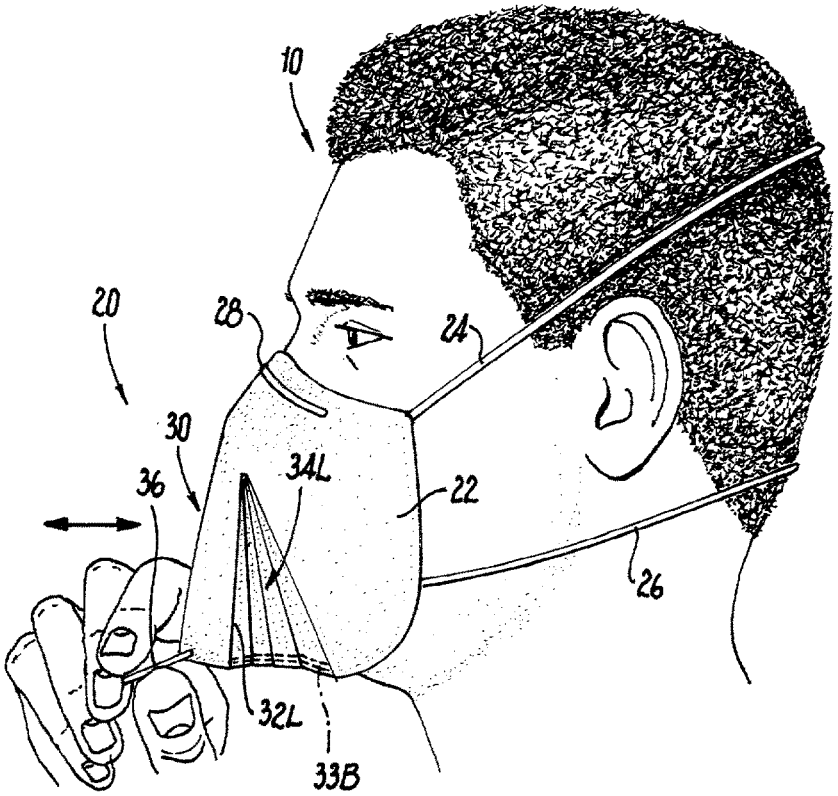
FIG. 11 depicts a side perspective view of the protective face mask of FIGS. 8, 9 and 10, highlighting the cord and flap in a deployed state.

Essentially, the protective mask enables access to the wearer's mouth at will, i.e., the wearer may manually move a flap portion 30 to create a temporary opening from the bottom proximate the wearer's chin that allows access to the wearer's mouth from below. The temporary opening as seen in FIG. 11 is appropriate for the wearer of the mask to both eat and drink. The wearer grasps the tether 36 attached to the mask 20, preferably without touching the mask, flap portion or wearer's face, and draws on the tether (and flap portion 30 attached thereto) away from the mask thereby creating the opening below the mask. The tether 36 creates separation between the hand and face so there is no need to touch the mask while using it. When the tether 36 is pulled away from the face, the opening is only underneath (below the user's mouth).

Preferably, the left bellows section 34L and the right bellows section 34R are made from a material that the mask body 22 is made from, but which may be the similar, thicker or thinner than the mask body. The left bellows section 34L and the right bellows section 34R fold in an accordion style manner and have just enough elastic in the elastic straps 33B in it to be able to return the flap portion 30 back to its closed mask position, when the wearer releases the tether 36. When fully extended, the flap portion 30 allows up to a 4"×4" opening in the bottom of the mask, under the user's mouth. Alternatively, the bellows section and pleats may be replaced by a flexible, stretchable, elastic material on each side of the flap portion 28.

Figure 12:
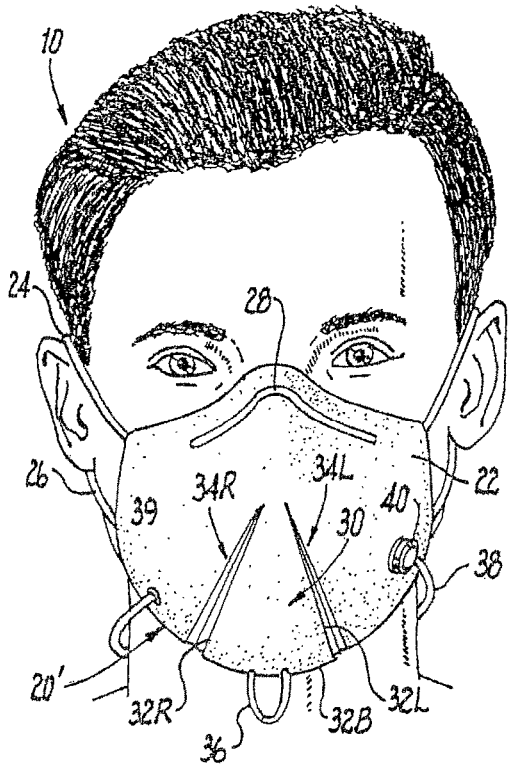
FIG. 12 is a front plan view of an alternative embodiment of the protective face mask of FIGS. 8-11.

FIG. 12 presents an alternative embodiment of the inventive protective face mask 20'. Protective face mask 20' is constructed similarly to protective masks 20, but straps 24, 26 are continuous to form a loop around the user's ears, as shown. Protective face mask 20' may also include a lower strap 38 to be secured against the user's neck. Strap 38 is preferably, is permanently attached at one end to a mask body position 39, as shown, where the other end of the lower strap 38 is detachably connectable to a button or snap 40 on the opposite side of the mask, to attach and hold lower strap 38. In this way, the optional lower strap 38 can be attached at the button or snap 40 without moving the strap 38 over the wearer's head. For that matter, the area of the mask body around the mouth may be more rigid than the surrounding material. whereby the mask allows for chewing and making eating more comfortable when the mask is closed over the user's face.

Figure 8:
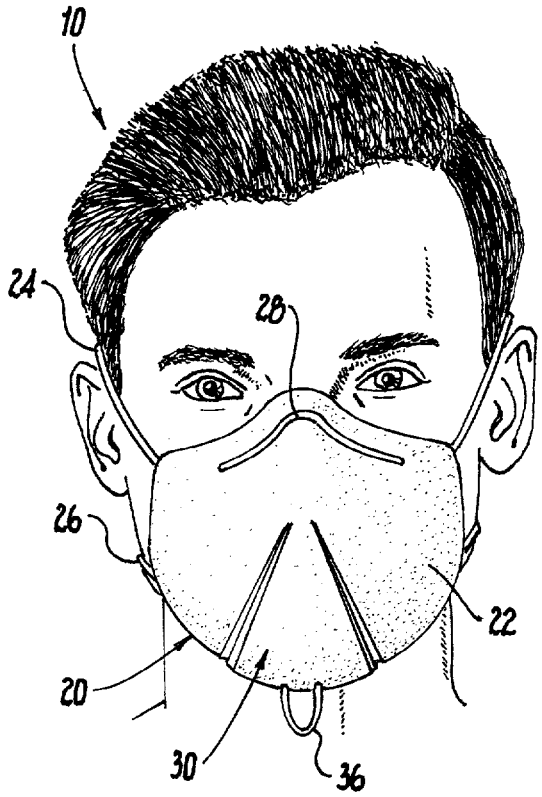
FIG. 8 depicts a protective face mask constructed according to the inventive principles.
Figure 9:
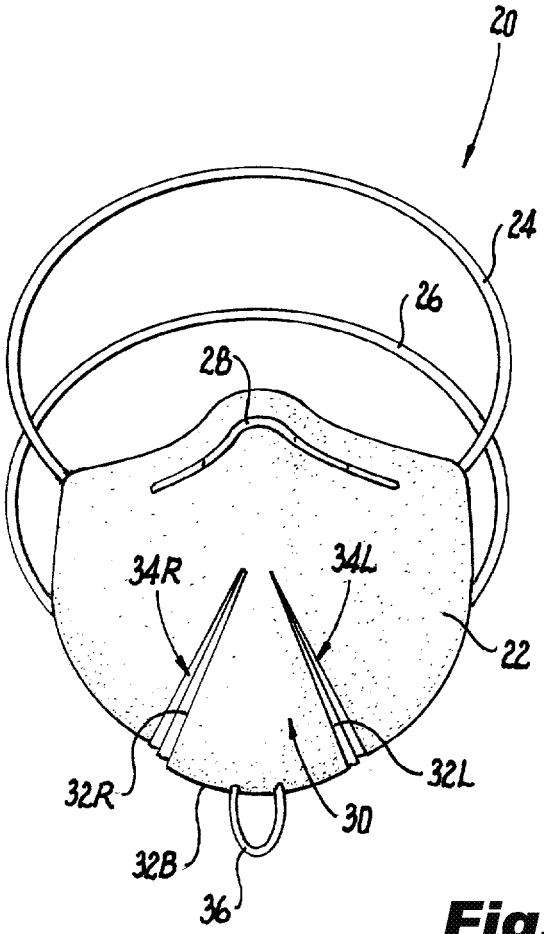
FIG. 9 depicts an enlarged view of the protective face mask depicted in FIG. 8.
Figure 10:
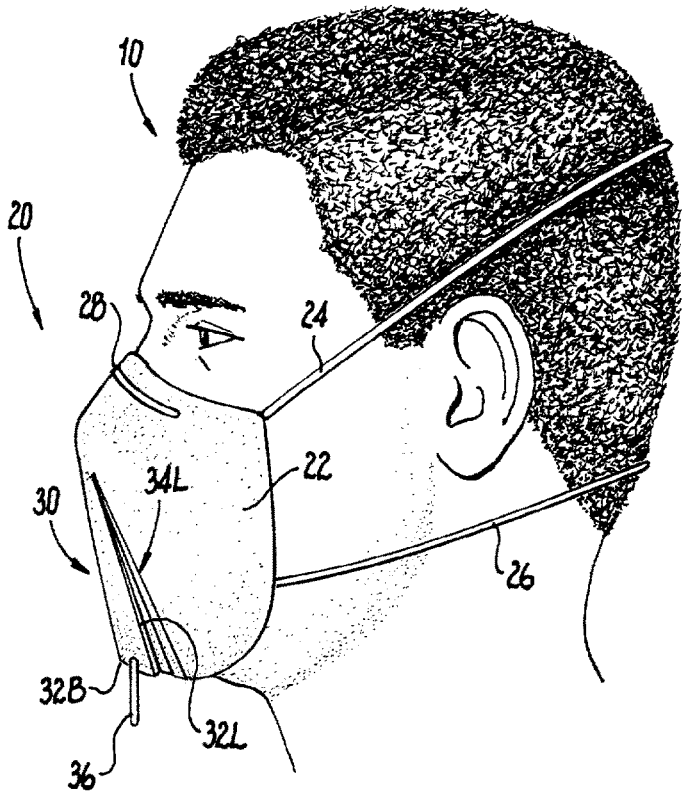
FIG. 10 depicts a side perspective view of the protective face mask of FIGS. 8 and 9, highlighting the cord and flap in a non-deployed state.
Figure 13B:
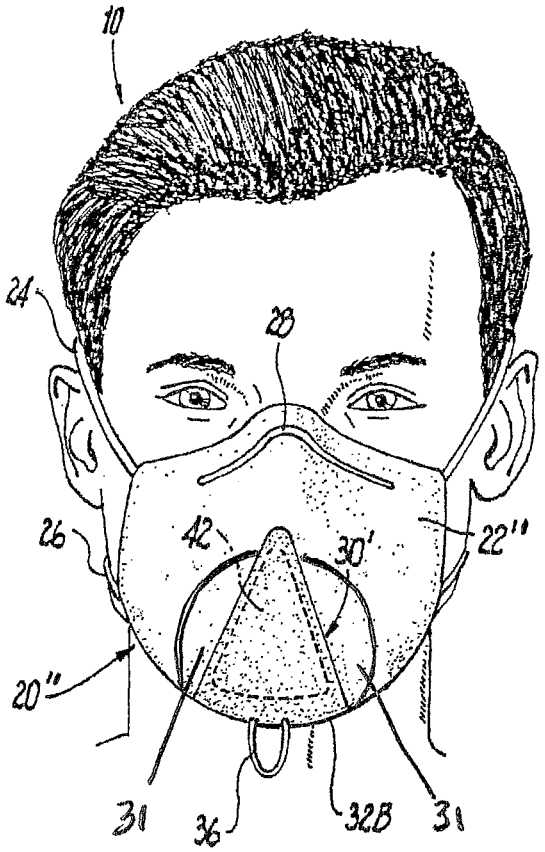

FIG. 13A depicts an alternative embodiment of the protective face mask of FIG. 8. The FIG. 13A mask 20' includes a stretchable flap portion 30', attached to the remainder mask body 22, as shown, which is formed to be stretchable. Cord 36 is attached to the stretchable flap portion 30'. Grasping and drawing the cord away from the mask/wearer's face cause the stretchable flap portion 30' to stretch and lift off the wearer's face, proximate the mouth, to realize a temporary opening for food or drink intake. The stretchable portion 30' falls back into place over the wearer's face/mouth once the drawing away force on the cord 36 is relaxed. FIG. 13B depicts an alternative embodiment of the protective face mask, mask 20", where an area 31 of the mask body 22" Proximate the mouth of the wearer, which area 31 also is proximate the flap 30', is more rigid than the mask body material forming a remainder of the mask body 22" that surrounds the mask body material forming the more rigid mask area.

Preferably, the mask body 22 comprises a continuous sheet of flexible and stretchable fabric that does not have any holes, apertures, openings or gaps that pierce the continuous layer of material covering both the nose and mouth. For that matter, the mask may include an attached filter material 42, shown in dashed lines in FIG. 13 to indicate that the filter material 42 is arranged between the mask body 22/stretchable flap portion 30' and the wearer's mouth. For that matter, the area of the mask body around the wearer's mouth preferably is more rigid than the surrounding material, whereby the mask allows for chewing and making eating more comfortable when the mask is closed over the user's face.

FIG. 14 presents a mask 20" that is an alternative embodiment of the masks 20, 20' and 20", depicted in FIGS. 8-13. Mask 20' as shown includes at least one one-way valve 44, positioned to make breathing easier, as well known to persons skilled in the art. Please note that while FIG. 14 depicts the mask 20' as including either flap portion 30 (FIGS. 8-12) or stretchable flap portion 30', the invention is not limited thereto.

Alternatively, the mask body 22 may include inserts of filter material or filtered valves sufficient to allow the user to breath, and the mask body 22 may be made of a non-breathable material, where breathing is permitted by the filter material inserts or filtered valves placed in mask body 22.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit the scope of the invention, except as set forth in the following claims.

I claim:

1. A protective face mask (30) for maintaining a protective covering over a wearer's nose and mouth that allows for safe intake of food and/or drink, the protective face mask comprising:

a mask body (22), and upper (24) and lower (26) straps connected to the mask body (22) that allow the protective face mask to be secured to the wearer's head (10);

wherein the mask body (22) includes a flap portion (30) that is connected to a remainder of the mask body by left and right bellows portions (34R, 34L), and wherein a tether (36) is connected to the flap portion (30) that is configured to be grasped and to have a force applied to draw the flap portion (30) away from the face of the wearer, to expand the left and right bellows portions (34R, 34L), and thereby create an opening under a bottom edge (32B) of the flap portion, at the bottom of the mask body (22) to permit access to the wearer's mouth from below, without removing the mask and maintaining the remainder of the mask body (22) on the wearer, until the force applied is removed.

2. The protective face mask of claim 1, wherein the flap portion includes a left edge (32L), a right edge (32R) and a bottom edge (32B).

3. The protective mask of claim 2, wherein the bellows portions (34R, 34L) are pleated, and connect the left and right edges (32L, 32R) of the flap portion to the mask body.

4. The protective mask of claim 1, wherein the mask body (22) comprises a continuous sheet of flexible, filter material for covering both the nose and the mouth, and wherein the continuous sheet of flexible, filter material does not have any holes, apertures, openings or gaps that pierce the continuous sheet, including the flap portion.

5. The protective mask of claim 1, wherein the mask body (22) including the flap portion (30) comprises a flexible, semi-rigid or rigid material.

6. The protective mask of claim 1, wherein the mask body (22) is moldable to a shape of the wearer's face.

7. The protective mask of claim 1, wherein the mask body further comprises a one-way valve (44) arranged to allow for easier breathing.

8. The protective mask of claim 1, further comprising an attached filter material (42) configured to be arranged between the flap portion of the mask body (22) and the wearer's nose and mouth and configured to further filter air passing through the mask.

9. A protective face mask (30) for maintaining a protective covering over a wearer's nose and mouth that allows for safe intake of food and/or drink, the protective face mask comprising:

a mask body (22), and upper (24) and lower (26) straps connected to the mask body (22) that allow the protective face mask to be secured to the wearer's head (10);

wherein the mask body (22) includes a flap portion (30) that is connected to a remainder of the mask body by a flexible, stretchable, elastic material arranged on each side of the flap portion between the flap portion and the remainder of the mask body, wherein a tether (36) is connected to the flap portion (30) that is configured to be grasped and to have a force applied to draw the flap portion (30) away from the face of the wearer, to expand the flexible, stretchable, elastic material on each side of the flap portion, and thereby create an opening under a bottom edge (32B) of the flap portion, at the bottom of the mask body (22), to permit access to the wearer's mouth from below, without removing the mask and maintaining the remainder of the mask body (22) on the wearer, until the force applied is removed.

10. A protective face mask (30) for maintaining a protective covering over a wearer's nose and mouth that allows for safe intake of food and/or drink, the protective face mask comprising:

a mask body (22), and left side and right side straps connected to the mask body (22) that allow the protective face mask to be secured to the wearer's head (10), which left and right side straps are configured to form a continuous loop around a user's ears when deployed, wherein the mask body (22) includes a flap portion (30) that is connected to a remainder of the mask body by left and right bellows portions (34R, 34L), and wherein a tether (36) is connected to the flap portion (30) that is configured to be grasped and to have a force applied to draw the flap portion (30) away from the face of the wearer, to expand the left and right bellows portions (34R, 34L), and thereby create an opening under a bottom edge (32B) of the flap portion, at the bottom of the mask body (22) to permit access to the wearer's mouth from below, without removing the mask and maintaining the remainder of the mask body (22) on the wearer, until the force applied is removed.

11. The protective mask of claim 1, further comprising a button or snap (40) on one side of the mask body (22) proximate the flap portion;

wherein one end of the lower strap is fixed to the mask body opposite the one side of the mask body proximate the stretchable lower portion, and another end of the lower strap is detachably connected to the button or snap (40).

12. The protective mask of claim 11, wherein the straps are made of stretchable material so that the straps are configured to be stretched by application of a stretching force, and such that upon removal of the stretching force, the straps return to their non-stretched form.

13. A protective face mask for maintaining a protective covering over a wearer's nose and mouth that allows for safe intake of food and/or drink, the protective face mask comprising:

a mask body (22), and upper and lower straps (24, 26) connected to the mask body that allow the protective face mask to be secured to the wearer's head;

wherein the mask body includes a stretchable lower portion that is connected to the mask body (22) that is configured to be positioned below the nose of the wearer, and wherein a tether (36) is connected to the stretchable lower portion and configured to be grasped and receive a force applied to draw the stretchable lower portion away from the face of the wearer to create an opening under a bottom edge (32B) of the stretchable lower to permit access to the wearers mouth from below, without removing the mask and maintaining the remainder of the mask body (22) on the wearer, until the force applied is removed.

14. The protective mask of claim 13, wherein the mask body (22) and stretchable lower portion together comprise a substantially continuous sheet of flexible and stretchable fabric, which does not have any holes, apertures, openings or gaps that pierce the continuous sheet of flexible and stretchable fabric which is configured to cover both the nose and the mouth.

15. The protective mask of claim 13, wherein the mask body (22) and stretchable lower portion comprise flexible, semi-rigid or rigid material.

16. The protective mask of claim 13, wherein the mask body (22) is moldable to a shape of the wearer's face.

17. The protective mask of claim 13, wherein a filter material is configured to be included between the mask body and the wearer's nose and mouth configured to further filter air passing though the mask.

18. The protective mask of claim 13, further comprising filter material (42) configured to be attached between the stretchable lower portion and the wearer's nose and mouth configured to further filter air passing though the mask.

19. The protective mask of claim 13, wherein mask body material forming an area of the mask body configured to be proximate the mouth of the wearer is more rigid than mask body material forming a remainder of the mask body that surrounds the mask body material forming the more rigid mask area, whereby the mask is configured to allow for chewing and making eating more comfortable when the mask is closed over the user's face.

20. The protective mask of claim 13, wherein the mask body further comprises a one-way valve (44) arranged to allow for easier breathing.

21. The protective mask of claim 13, wherein the respective upper and lower straps (24, 26) are continuous to form respective loops around the user's head, above and below the ears.

22. The protective mask of claim 13, further comprising a lower strap (38) provided to surround the wearer's jaw to hold the mask firmly.

23. The protective mask of claim 22, further comprising a button or snap (40) at one side of the mask body proximate the stretchable lower portion;

wherein one end of the lower strap is fixed to the mask body opposite the one side of the mask body proximate the stretchable lower portion, and another end of the lower strap is detachably connected to the button or snap (40).

24. The protective mask of claim 23, wherein the straps are made of stretchable material so that the straps are configured to be stretched by application of a stretching force, and such that upon removal of the stretching force, the straps return to their non-stretched form.

* * * * *